US007080832B2

(12) United States Patent
Kaya et al.

(10) Patent No.: US 7,080,832 B2
(45) Date of Patent: Jul. 25, 2006

(54) SHEET MATERIAL FEEDER

(75) Inventors: Mehmet Oktay Kaya, Lee, NH (US); Edward James Limbert, Rochester, NH (US); Daniel Gregg DiMuzio, Cheviot, OH (US); Glen Roger Caron, Dover, NH (US)

(73) Assignee: Goss International Americas, Inc., Dover, NH (US)

( * ) Notice: Subject to any disclaimer, the term of this patent is extended or adjusted under 35 U.S.C. 154(b) by 17 days.

(21) Appl. No.: 10/437,508

(22) Filed: May 14, 2003

(65) Prior Publication Data

US 2004/0245699 A1 Dec. 9, 2004

(51) Int. Cl.
*B65H 3/08* (2006.01)

(52) U.S. Cl. ..... 271/100; 271/102; 271/107

(58) Field of Classification Search ..... 271/100, 271/95, 96, 99, 102, 103, 106, 107, 11
See application file for complete search history.

(56) References Cited

U.S. PATENT DOCUMENTS 4,060,228 A * 11/1977 Tress et al. ..... 271/14
4,155,546 A * 5/1979 Jacobs ..... 271/11
4,353,393 A * 10/1982 Schniter ..... 137/624.2
4,505,470 A * 3/1985 Reinert et al. ..... 271/100
5,014,979 A * 5/1991 Higgins et al. ..... 271/104
5,094,439 A 3/1992 Renner et al. ..... 271/90
5,116,040 A * 5/1992 Sauer ..... 271/101
5,120,041 A 6/1992 Schniter ..... 271/107
5,125,637 A * 6/1992 Glaser ..... 271/11
5,224,694 A * 7/1993 Magee ..... 271/95
5,366,215 A * 11/1994 Hastie et al. ..... 271/107
5,586,756 A * 12/1996 Chang ..... 271/11
5,984,296 A 11/1999 Fricke et al. ..... 271/93
6,102,387 A * 8/2000 Zerfahs ..... 271/99
6,168,148 B1 * 1/2001 Bechler et al. ..... 271/90
6,213,457 B1 4/2001 Schlough ..... 270/58.23
6,231,040 B1 5/2001 Langenegger ..... 271/107
6,502,815 B1 * 1/2003 Baureis et al. ..... 271/11
6,557,845 B1 * 5/2003 Kaya et al. ..... 271/90

FOREIGN PATENT DOCUMENTS

EP 1108664 8/2004

* cited by examiner

*Primary Examiner*—Kathy Matecki
*Assistant Examiner*—Matthew J. Kohner
(74) *Attorney, Agent, or Firm*—Davidson, Davidson & Kappel, LLC

(57) ABSTRACT

A sheet material feeder includes a sheet material holder for holding a pile of sheet material; a sucker bar device having at least one sucker for contacting the sheet material, the sucker bar device having a pivot axis, and an actuator for pivoting the sucker bar device about the pivot axis and having a first position and a second position. When the actuator is in the first position, the sucker pivoting about the pivot axis from a first angle where the sucker contacts the sheet material by a predetermined angle so that the sucker removes the sheet material from the pile; and when the actuator is in the second position, the sucker pivoting about the pivot axis from a second angle where the sucker does not contact the sheet material.

10 Claims, 3 Drawing Sheets

SHEET MATERIAL FEEDER

BACKGROUND INFORMATION

The present invention relates to sheet material feeders, for example hoppers for feeding sheet material such as signatures, individual sheets or inserts from a pile.

U.S. Pat. No. 6,213,457, hereby incorporated by reference herein, discloses for example an apparatus for feeding flat products from a bottom of a pile using a sucker rotating on a sucker shaft.

U.S. Pat. No. 5,984,296, also hereby incorporated by reference herein, discloses a lifting sucker for removing a top sheet from a stack of sheet. An adjusting knob can alter a stroke distance and a consequent spacing to the sheets by various adjustable spacings of the cam paths.

U.S. Pat. No. 5,094,439 discloses a device for locking a suction nozzle of a sheet separating sucker on a top-feeding sheet feeder having an abutment attached to a governor foot drive.

BRIEF SUMMARY OF THE INVENTION

It is sometimes desirable to provide for an inhibit mechanism for preventing sheets from being fed. In some prior art cam-driven devices, this inhibit mechanism has worked as a latch which removes the cam follower from the cam fully, or almost all the way off. When feeding resumes, the cam follower contacts the cam surface again all the time. However, this repeated release and contact can cause wear on the cam surface and cam and other elements in the feeder.

An object of the present invention is to provide a sheet material feeder with an inhibit mechanism which reduces cam/cam follower wear. Another alternate or additional object of the present invention is to provide a sheet material feeder which has an easily-implemented and effective inhibit mechanism.

The present invention provides a sheet material feeder comprising:

a sheet material holder for holding a pile of sheet material;

a sucker bar device having at least one sucker for contacting the sheet material, the sucker bar device having a pivot axis, and an actuator for pivoting the sucker bar device about the pivot axis and having a first position and a second position, when the actuator is in the first position, the sucker pivoting about the pivot axis from a first angle where the sucker contacts the sheet material by a predetermined angle so that the sucker removes the sheet material from the pile; and when the actuator is in the second position, the sucker pivoting about the pivot axis from a second angle where the sucker does not contact the sheet material.

By providing an actuator to alter the phase of the pivot angle, the sheet material feeder can be provided with an easily implemented and effective inhibit mode.

The sucker may continue to pivot by the predetermined angle when the actuator is in the second position. The actuator preferably is connected between the sucker bar device and a cam follower, the cam follower moving the sucker by the predetermined angle.

The cam and cam follower preferably remain in contact regardless of whether the actuator is in the first or second position.

The sucker bar device preferably includes a main shaft having the pivot axis and may have a sucker bar having a sucker bar axis parallel but offset to the pivot axis. The actuator then preferably alters the angle between the pivot axis and the sucker bar axis.

A block driven by the cam through the cam follower may be connected to the sucker bar via the actuator.

A support may extend from the sucker bar, and the actuator may be supported on the support via retaining springs.

A vacuum device may cut the vacuum to the sucker when the actuator is in the second position.

The feeder may be a bottom feeder.

The present invention also provides a method for removing sheets comprising the steps of:

rotating a sucker bar device in a first operation mode from a first angle where a sucker contacts the sheet material and transports the sheet material by a predetermined angle; and rotating the sucker bar device in a second inhibit operation mode from a second angle where the sucker does not contact the sheet material.

Vacuum to the sucker may be provided in the first operation mode and cut in the second operation mode.

BRIEF DESCRIPTION OF THE DRAWING

The present invention will be described with respect to a preferred embodiment in which.

DETAILED DESCRIPTION

Figure 1:
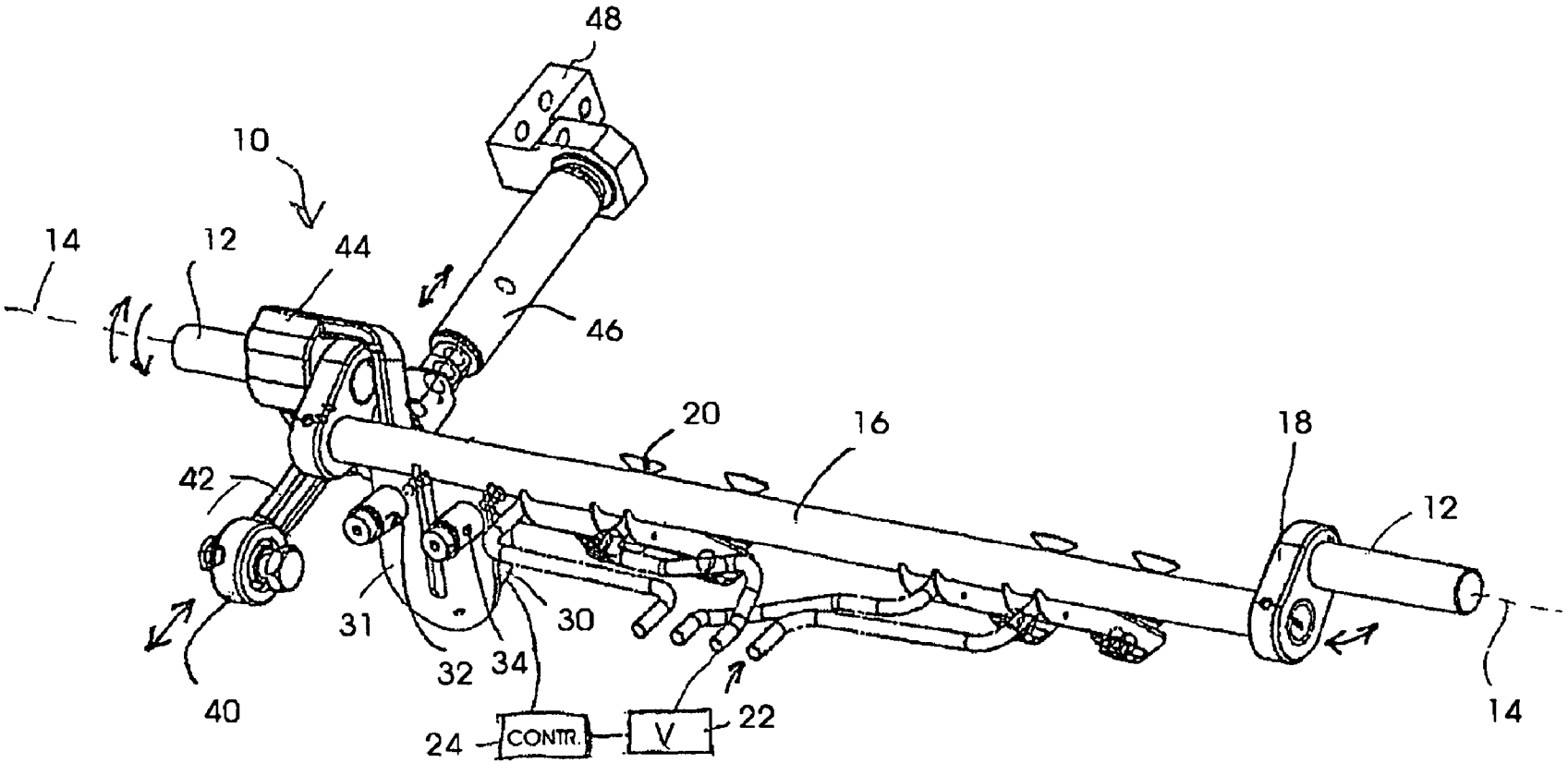
FIG. 1 shows a perspective view of the sucker bar device.

FIG. 1 shows a perspective view of the sucker bar device 10 of the present invention. A main shaft 12 is rotatably held in a housing of the sheet material feeder, and defines a pivot axis 14. A sucker bar 16 is connected via connectors 18 to the main shaft 12. Connectors 18 are pivotable about the pivot axis 14, but fixedly connected to sucker bar 16.

Sucker bar 16 includes a plurality of suckers 20 spaced axially, the suckers 20 being connected via tubing to a vacuum device 22. A controller 24 is connected to a vacuum device 22 for controlling suction to the suckers 20.

Figure 2:
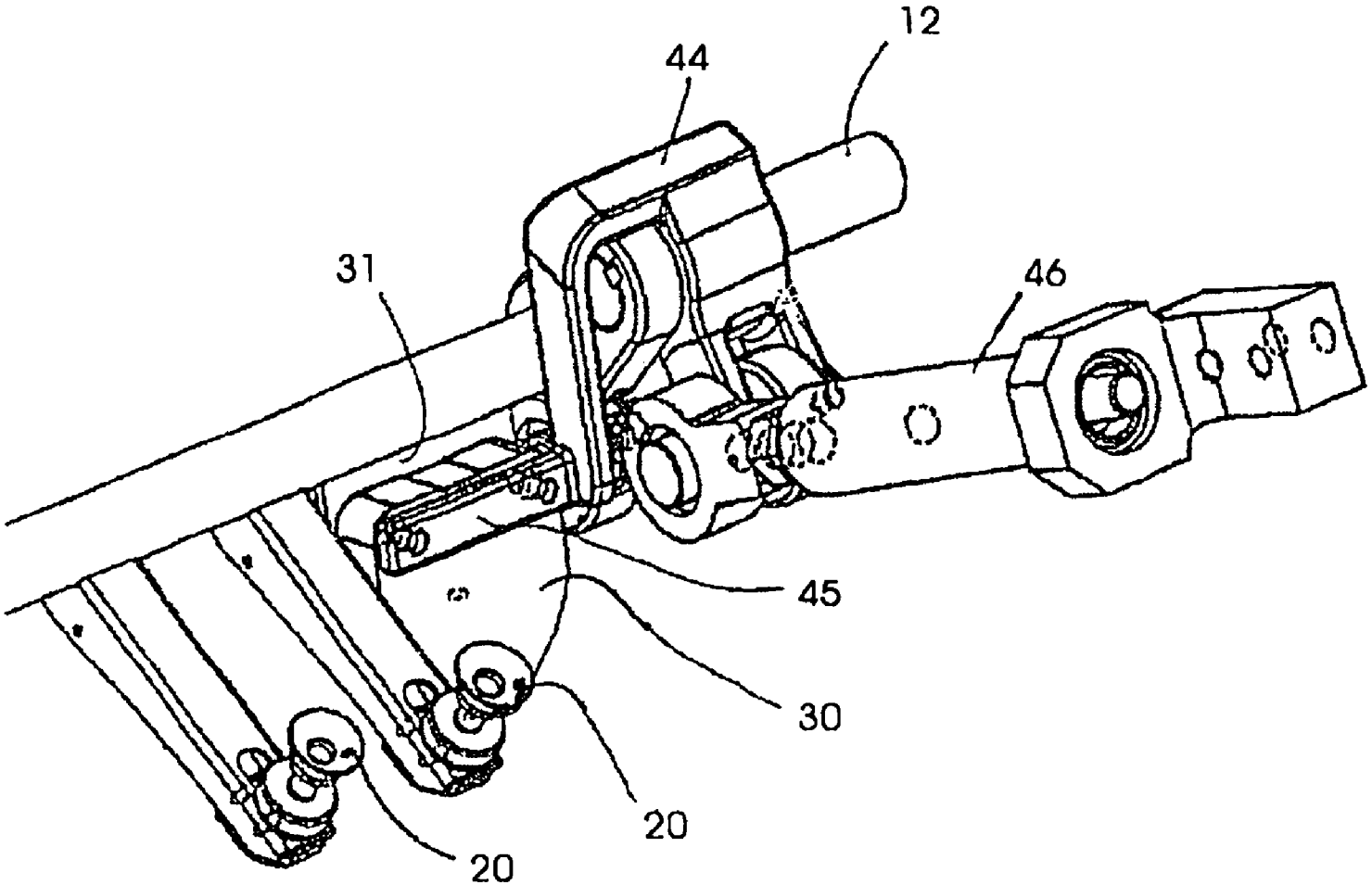
FIG. 2 shows a reverse perspective view of the sucker bar device.

A driven block 44, shown also in FIG. 2, is freely rotatable about shaft 12, and has an extension 45, shown in FIG. 2. Located between extension 45 and a support 31 fixedly connected to sucker bar 16 is an actuator 30, which is supported on support 31 via two springs 32, 34. In a first position, actuator 30 holds extension 45 close to support 31, and in a second position, the actuator 30 compresses the springs and pushes extension 45 away from support 31. Actuator 30 thus can change the angle between shaft 12 and sucker bar 16.

Regardless of which position actuator 30 is in, a link 40 connected to a cam follower may be driven by a cam, and act counter to a cam spring 46 fixed to a support 48 fixed to the sheet material feeder housing.

The cam follower via a link 42 drives block 44 to rotate it about shaft 12, and thus move the sucker bar 16 via support 31, and thus to move suckers 20.

Figure 3:
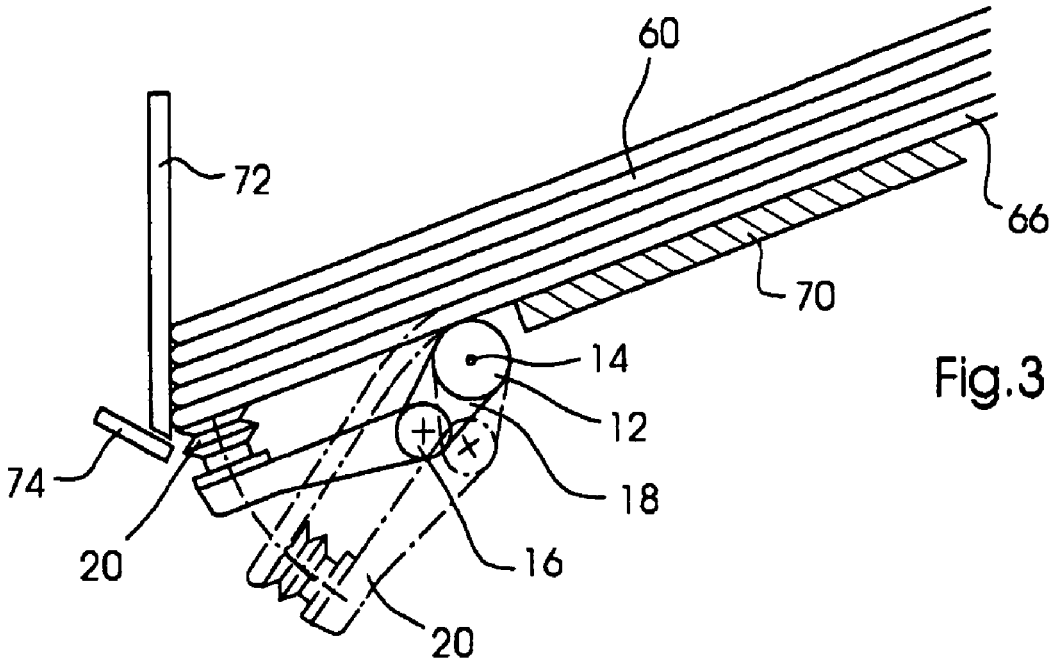
FIG. 3 shows the sheet material feeder in a first operation mode.

FIG. 3 shows the sucker 20 cam-actuated movement when the actuator 30 is in the first position where the extension 45 and support 31 are closer. Control device 24 ensures that vacuum 22 provides suction through suckers 20 to pull down a bottommost sheet 66 of a stack of sheet material 60. The stack of sheet material 60 rests on a tray 70 and has a front guide 72 and a restrictor 74.

Figure 4:
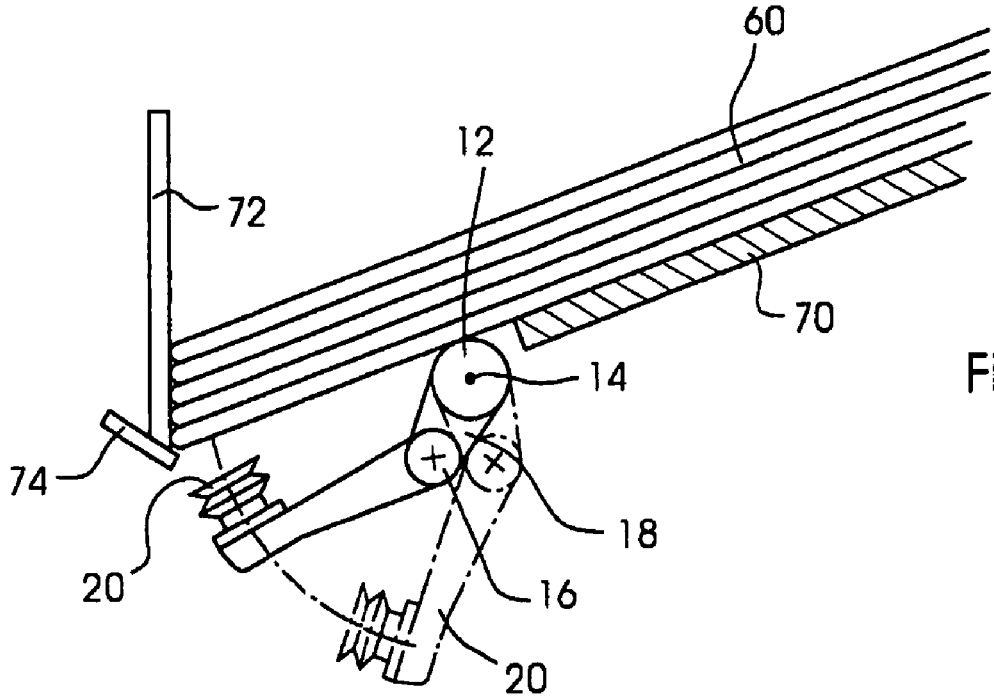
FIG. 4 shows the sheet material feeder in a second operational mode.

FIG. 4 shows the sucker 20 cam-actuated movement when the actuator is in the second inhibit position where the extension 45 pushes the support 45 further away. The controller 24 actuated the actuator and turns off vacuum 22. The sucker 20 continues to rotate, but no sheets are removed and the cam/cam follower contact can remain, thus reducing wear.

What is claimed is:

1. A sheet material feeder comprising:

a sheet material holder for holding a pile of sheet material;

a sucker bar device having at least one sucker for contacting the sheet material, the sucker bar device having a pivot axis, and an actuator for pivoting the sucker bar device about the pivot axis and having a first position and a second position, when the actuator is in the first position, the sucker pivoting about the pivot axis from a first angle where the sucker contacts the sheet material by a predetermined angle so that the sucker removes the sheet material from the pile; and when the actuator is in the second position, the sucker pivoting about the pivot axis from a second angle where the sucker does not contact the sheet material;

the sucker bar device including a main shaft having the pivot axis and a sucker bar having a sucker bar axis parallel but offset to the pivot axis; and a support extending from the sucker bar, the actuator being supported on the support via retaining springs.

2. The sheet material feeder as recited in claim 1 wherein the sucker pivots by the predetermined angle when the actuator is in the second position.

3. The sheet material feeder as recited in claim 1 further comprising a cam follower connected to the sucker bar device via the actuator, the cam follower moving the sucker by the predetermined angle.

4. The sheet material feeder as recited in claim 3 wherein the cam follower moves the sucker regardless of whether the actuator is in the first or second position.

5. The sheet material feeder as recited in claim 1 wherein the actuator alters an angle between the pivot axis and the sucker bar axis.

6. The sheet material feeder as recited in claim 1 further comprising a block driven by a cam follower, the block rotatable about the main shaft, and connected to the sucker bar device via the actuator.

7. The sheet material feeder as recited in claim 1 further comprising a vacuum device cutting a vacuum to the sucker when the actuator is in the second position.

8. The sheet material feeder as recited in claim 1 further comprising a tray providing access to a bottommost one of the sheet material.

9. A sheet material feeder comprising:

a sheet material holder for holding a pile of sheet material;

a sucker bar device having at least one sucker for contacting the sheet material, the sucker bar device having a pivot axis, and an actuator for pivoting the sucker bar device about the pivot axis and having a first position and a second position, when the actuator is in the first position, the sucker pivoting about the pivot axis from a first angle where the sucker contacts the sheet material by a predetermined angle so that the sucker removes the sheet material from the pile; and when the actuator is in the second position, the sucker pivoting about the pivot axis from a second angle where the sucker does not contact the sheet material;

the sucker bar device including a main shaft having the pivot axis and a sucker bar having a sucker bar axis parallel but offset to the pivot axis;

the actuator altering an angle between the main shaft and the sucker bar.

10. A sheet material feeder comprising:

a sheet material holder for holding a pile of sheet material;

a sucker bar device having at least one sucker for contacting the sheet material, the sucker bar device having a pivot axis, and an actuator for pivoting the sucker bar device about the pivot axis and having a first position and a second position, when the actuator is in the first position, the sucker pivoting about the pivot axis from a first angle where the sucker contacts the sheet material by a predetermined angle so that the sucker removes the sheet material from the pile;

when the actuator is in the second position, the sucker pivoting about the pivot axis from a second angle where the sucker does not contact the sheet material; and the sucker bar device including a main shaft having the pivot axis and a sucker bar having a sucker bar axis parallel but offset to the pivot axis;

a cam follower link for driving the sucker bar device; and a fixed support, the actuator connected at one end to the fixed support.

* * * * *